United States Patent [19]

deSouza

[11] Patent Number: 4,684,353

[45] Date of Patent: Aug. 4, 1987

[54] FLEXIBLE ELECTROLUMINESCENT FILM LAMINATE

[75] Inventor: Antonio S. deSouza, Mercer County, N.J.

[73] Assignee: Dunmore Corporation, Newtown, Pa.

[21] Appl. No.: 766,443

[22] Filed: Aug. 19, 1985

[51] Int. Cl.[4] ..... H01J 9/12

[52] U.S. Cl. ..... 445/51; 156/289; 427/66; 445/52

[58] Field of Search ..... 445/49, 51–52, 445/24; 156/289, 344, 285; 427/64, 71, 66

[56] References Cited

U.S. PATENT DOCUMENTS

| | | | |
|---|---|---|---|
| 2,733,367 | 1/1956 | Gillson, Jr. | 313/108 |
| 2,945,976 | 7/1960 | Fridrich | 156/285 |
| 3,052,810 | 9/1962 | Mash | 313/108 |
| 3,315,111 | 4/1967 | Jaffe et al. | 313/108 |
| 3,341,915 | 9/1967 | Knochel et al. | 445/52 |
| 3,393,337 | 7/1968 | Panerai et al. | 427/66 |
| 3,580,738 | 5/1971 | Ranby | 117/215 |
| 3,620,872 | 11/1971 | Backwell | 156/289 |
| 4,087,300 | 5/1978 | Adler | 156/289 |
| 4,097,776 | 6/1978 | Allinikov | 313/502 |
| 4,143,297 | 3/1979 | Fischer | 313/502 |
| 4,534,743 | 8/1985 | D'Onofrio et al. | 445/49 |
| 4,560,902 | 12/1985 | Kardon | 156/330 X |

*Primary Examiner*—Kenneth J. Ramsey
*Attorney, Agent, or Firm*—B. Max Klevit

[57] ABSTRACT

Electroluminescent elements of high light intensity and long useful life, operating at comparatively low energy input, are obtained by directly bonding to a supported web of thin plastic film without intermediate adhesive a layer of resin containing EL phosphor thoroughly and uniformly dispersed therein, and depositing on the surface of said resin a fine layer of a transparent electrode consisting essentially of indium tin oxide. In alternative embodiments the said resin layer is sandwiched between thin deposited layers of alkaline earth metal titanate.

16 Claims, 3 Drawing Figures

FLEXIBLE ELECTROLUMINESCENT FILM LAMINATE

BACKGROUND OF THE INVENTION

1. Field of the Invention

The present invention relates to electroluminescence and is particularly concerned with the production of flexible phosphor-containing structures generating visible light by electrical field excitation, for use in lighting and display devices.

2. Prior Art

While a fairly large number of patents have been issued directed to asserted improvements in electroluminescent (EL) devices, these devices to date have not received significant market acceptance for various reasons apparently because of serious drawbacks, including but not limited to one or more of the following: high energy input required for the light intensity obtained, relatively short useful life of the light emitting element and the comparatively high manufacturing costs of certain of the proposed more complicated structures.

There prior art devices, in general, employ as the light producing element a bonded laminate comprising a layer of phosphor particles dispersed or embedded in a dielectric matrix and an electrode member bonded to each face or surface of the phosphor-containing layer in some instances by an intervening dielectric material, at least one of the electrodes being light transmitting.

Among early patented EL lamp structures of the flexible type is that described in U.S. Pat. No. 2,733,367. The light emitting element of the patent comprises, according to a preferred embodiment disclosed, a polyethylene terephthalate film (PET) containing finely divided phosphor material, such as activated zinc sulfide, dispersed in the PET film. This light-emitting element is sandwiched between aluminized PET films bonded to the light-emitting element by adhesive cement. The described laminate is energized to emit light in the visible range by connecting the aluminized surfaces to a source of alternating current at a potential in the order of 400 volts at a frequency of 10 kilocycles. In other embodiments disclosed in the patent the phosphor may be contained in other dielectric matrices, such as beeswax, solidified oils, plasticized cellulose-nitrate, etc.

The following later-issued patents are illustrative of the subsequent developing state of the art.

U.S. Pat. No. 3,052,810 advocates the use of a fluorescent material mixed with or disposed in contact with the EL phosphor layer, to absorb at least part of the light emitted by the phosphor so as to emit light at a longer wavelength than that of the absorbed light. Among the flluorescent substrates listed in the patent are rhodamine, fluorescine, and commercially available "Day-Glow" materials.

U.S. Pat. No. 3,315,111 features a flexible EL laminate asserted to be operative at 120 volts, 60 cycle AC input. The phosphor-containing layer is sandwiched between a pair of electrode layers, of which at least the front electrode has a light transmittance capacity of at least 60%. A barrier layer, composed of barium titanate dispersed in an organic polymeric matrix of high dielectric constant, such as plasticized cyanoethyl cellulose is employed as an insulation between the back electrode and the phosphor-containing layer. The matrix containing the phosphor may likewise be formed of cyanoethyl cellulose, as also is the light-transmitting lacquer electrode matrix in which electro-conductive particles, such as metal oxide pigment, is incorporated, for example indium oxide doped with a few percent of tin. The assembled laminate is encapsulated in a transparent plastic envelope.

U.S. Pat. No. 3,341,915 discloses a technique for assembling and bonding the several strata of an EL lamp element. A layer of light-transmitting electrically-conductive material such as copper iodide is deposited on a rigid solid temporary support to provide a light-transmitting electrode. A layer of phosphor-impregnated plastic dielectric in liquid state is deposited over the copper iodide, and covered, in turn, by a thin, light-reflecting back electrode of aluminum. After the phosphor-impregnated plastic layer has had sufficient time to cure and become securely bonded to the copper iodide, the formed unit is peeled from the underlying rigid support, which is made of a material to which copper iodide does not strongly adhere. The stripped self-supporting assembly is encased in a plastic protective envelope.

U.S. Pat. No. 3,580,738 asserts that the use of a thin coating of aluminum as the light-transmitting electrode of an EL device is undesirable in that the light transmission is thus reduced to unacceptable level. To overcome this drawback, the patent proposes the use as the light-transmitting electrode a thin layer of indium metal deposited on a transparent plastic. The deposited layer is heated in air and acid washed to improve electrical conductivity and light transmission. Cyanoethyl cellulose is recommended as a matrix for the phosphor-containing layer. The indium may be applied by vacuum deposition or by sputtering. A layer of high dielectric constant material (alkali earth metal titanate) in an organic binder is interposed between the phosphor layer and the back electrode.

U.S. Pat. No. 4,097,776 advocates coating of the individual granules of the EL phosphor with a liquid crystal substance. The thus coated phosphors are said to be highly resistant to moisture and certain other deteriorating influences.

U.S. Pat. No. 4,143,297 discloses a rather elaborate EL information display panel. The emphasized features of the patent are the use of as the light-emitting element a dielectric resin incorporating an unpatterned layer of EL power particles of one particle thickness, and use of a black back electrode to increase visual contrast. Fluorescent material may be included in the dielectric resin. Insulating films are interposed between the phosphor-containing resin layer and the front and back electrodes respectively.

SUMMARY OF THE INVENTION

In accordance with the present invention flexible phosphor containing plastics of simple construction are produced, capable of generating visible light by electric current excitation, providing enhanced brightness at comparatively low applied voltage and frequency and with accompanying extended useful life. The multi-layered films produced in accordance with the invention can be usefully employed in EL lamp structures as well as the light-emitting element in EL display panels. The products of the invention, in several embodiments hereinafter described in detail, comprise in general a thin base film of a selected dielectric plastic. The base film is temporarily mounted onto a relatively thick flexible support film by an easily releaseable pressure-sensitive adhesive, so as to enable processing of the thin base film without damage thereto.

The mounted base film is then coated with a layer of a thermoplastic resin containing distributed therein finely divided particles of electroluminescent phosphor. The phosphor-containing resin is bonded directly to the exposed surface of the base film by passing the laminate (composed of the base film mounted on the carrier film and the phosphor containing resin coated on the base film) through calendering rollers under pressure and at moderately elevated temperature.

Having completed deposition and bonding of the phosphor-containing resin to the base film, the underlying support film may now be stripped therefrom. A thin transparent layer of conductive material is applied over the surface of the phosphor-containing resin. The applied conductive material, preferably in the form of sputtered indium tin oxide (ITO), serves as the transparent front electrode. The back electrode is applied to the exposed underside of the base film, replacing the removed support film. The back electrode may be a single coating covering all or part of the under surface of the base film or a plurality of patterned figures of desired design, the applied pattern determining what will be the visible design seen at the upper transparent face of the front electrode. The phosphor in the assembly is energized by an electric circuit connecting at the front and back electrodes.

Further improvement are had in the quality of the obtained EL structure, particularly as to light intensity at a given input voltage, by various modifications of the basic structure as will hereinafter be described.

DETAILED DISCLOSURE OF EMBODIMENTS

Figure 1:
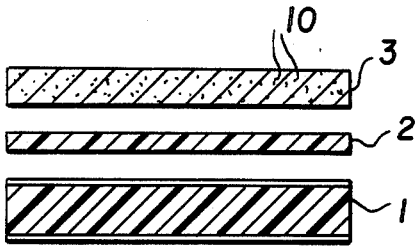
FIG. 1 of the accompanying drawings is an exaggerated schematic representation of the invention product at an intermediate stage of its manufacture, the several layers being shown in detached position for clarity. The illustrated thichnesses of the component layers are not scaled in proportion to actual size.

As seen in FIG. 1, a flexible plastic support film 1 is provided to support the thin base film 2 temporarily mounted thereon to enable handling without injury to the thin film. While 92 gauge polyethylene terephyhalate has been generally employed in practice of the invention, the choice of the support film 1 is optional and various other flexible plastic materials of suitable thickness, as in the range of about 0.75 mils to about 2 mils (19μ to 50μ) may be substituted. The performed thin film 2 is loosely attached to film 1 by a heat-sensitve releaseable adhesive applied to the contacting face of film 1 and running the mounted pair through the nip of opposed rollers under light pressure (of about 80 psi) and at a temperature generally in the range of about 275°+/−25° F. (135°+/−15 C.) at a running speed of about 10 feet (3 meters) per minute. Although not limited thereto, film 2 may be made of stretched or unstretched PET having a thickness in the order of about 25 gauge (6μ). Another plastic material found desirable for use as base film 2 is polyvinyl fluoride at a preferred thickness of about 50 gauge (12μ). Other suitable plastics of suitably high dielectric constant that can be used for the base film 2 are set out below.

The next step in the procedural sequence is the application of the light-generating phosphor-containing layer 3 to the exposed surface of film 2. Any of the known commercial EL generating phosphors 10 may be employed in practice of the present invention, such as the familiar zinc sulfide activated by minor amounts of copper and/or manganese. The phosphor particles may generally be of wide size range distribution, except in embodiments hereinafter described, as over the 10μ to 80μ range but predominating preferably in the range of 25μ to 45μ. The phosphor particles may be incorporated in a molten thermoplastic resin or in an organic solution of a suitable resin in a concentration of 60% to 78% by total weight of the resin layer and contents, to obtain fairly uniform distribution of the phosphor throughout the resin matrix, these should be mixed in a high intensity blender.

While a wide choice of resins is available for binding or embedding the phosphor particles, those of high dielectric constant are particularly preferred in most instances. In the following Table 1 a number of resins suitable for use as matrices for the phosphor are listed together with their dielectric constants.

TABLE 1

| Resin | Clarity | Dielectric Constant at 60 cps |
|---|---|---|
| Polyester (PET) | transparent | 2.5–3 |
| Polyvinyl fluoride (PVF) | transparent | 11 |
| Cyanoethyl cellulose (CEC) | transparent | 28 |
| Ethyl cellulose | transparent | 3.0–4 |
| Alkyd | transparent | 4.0–5 |
| Copolymer of CEC with acrylate | transparent | 10–11 |
| Epoxy | transparent | 3.0–4 |

The resin containing incorporated phosphor particles is applied as a tacky layer 3 to the exposed surface of film 2, for example by a web screen coating device. The applied layer, after drying may have a thickness of 2 to 5 mils (50 to 125 microns) preferably in the range of about 3 mils (75 microns). At the described concentration (60 to 78 wt %) of the phosphor particles in the resin matrix layer, the particles predominately will be distributed within the resin layer as a single particle strata.

In accordance with the preferred practice, bonding of the resin layer 3 to the surface of film 2 is accomplished by passing the resin coated film through heated calender rollers under pressure, for example at a temperature of 300° F. (150° C.) and at a pressure of 100 psi (7kg/cm$^2$).

At this stage in the described procedure the laminate discharged from the rollers can be further handled without need for support on film 1. Film 1 is now readily removed by peeling the same from the bottom of film 2.

Figure 2:
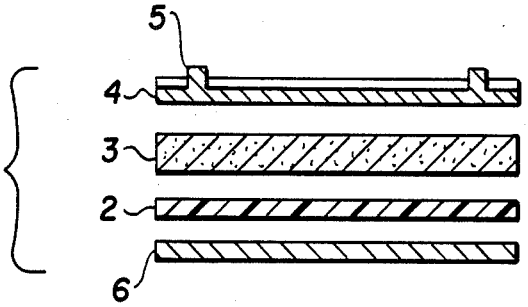
FIG. 2 is a schematic representation of the invention product at a later completed stage in its manufacture.

In the next step a transparent front electrode 4 is directly applied to the exposed surface of the phosphor-containing layer 3, as shown in FIG. 2. For this transparent electrode commercially available indium tin oxide (I.T.O.) may be employed, which is preferably deposited on the cured resin surface by a sputtering technique at a thickness of 100Å to 1000Å, so as to have a resistance in the range of about 750–1300 ohms/- square. Other transparent electrodes can be employed, not necessarily with equivalent results, having a stable resistance in the stated range and possessing sufficiently high transparency.

One or more terminals 5 are applied to the upper surface of electrode 4 to provide for connection thereto of an electrical conducting line or lines. Thus, as shown in FIG. 3, a continuous bus bar 5 may be printed on the surface of electrode 4, using pure silver flake ink and a screen of about 220 mesh.

In accordance with the preferred practice of the invention all of the steps applied in the manufacture of the flexible EL laminate up to this point are carried out with the film 2 in the form of a web of continuous running length. The obtained web 2 with attached layers 3, 4, 5 thereon may now be cut to pieces of desired dimension before application of the back electrode 6 to the under surface of film 2. Alternatively, if desired, the web may be cut to provide sheets or panels of desired dimension, prior to application of the transparent electrode 4 thereon.

The back electrode 6 may be applied by printing pure silver flake ink on the underside of film 2. The ink applied at 5 and at 6 is dried by heating the printed laminate, which may be done in an oven at about 190° F. (88° C.) for about 5 minutes.

Figure 3:
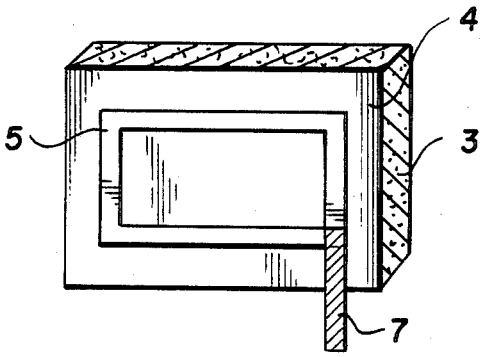
FIG. 3 is a top plan view of the product illustrated in FIG. 2.

Electrical conductor lines are attached respectively to terminal 5 and back electrode 6, which, for example, may be in the form of copper foil or wire mesh ribbon, as shown at 7 (FIG. 3).

The back electrode 6 may be applied uniformly as a continuous layer on the whole or selected part of the surface of film 2 and in any desired pattern. The design pattern of the back electrode 6 will be reproduced as the lighted area or areas transmitted through the transparent electrode 4, when the device is electrically energized. For use in display devices the back electrode 6 may be in the form of spaced individual ornamental or informational images, in which event separate electrical conductors will be attached to the individual characters 6 to operate simultaneously or in any desired sequence.

The completed EL laminated structure as illustrated in FIG. 2 may be protected against moisture, oxygen, sulfur, etc. in the environment, by encapsulating in suitable transparent plastic film, such as fluorocarbon resins (e.g. "Aclar").

Several detailed illustrative examples of different specific embodiments of the invention are hereinafter described, although not limited thereto.

EXAMPLE 1

Preformed 25 gauge PET film was mounted on a 2 mil PET carrier film by an easily releaseable low pressure-sensitive adhesive. A copper-activated zinc sulfide phosphor was dispersed in a solution of polyethylene terephthalate resin by mixing in a high-intensity blender, forming a mixture comprising of 68% phosphor and 32% resin by weight. This mixture was applied to the web of the mounted 25 gauge PET film by web screen printing and the thus coated web dried in a drying tunnel at 175° F. (80° C.), followed by further drying at 310° F. (155° C).

The dried film was polished by being passed between a steel roller and a neoprene rubber roller at 300° F. (149° C.) and at a pressure of 100 psi (7kg/cm$^2$). Indium tin oxide was sputtered into the polished side to obtain a coating thickness in the range of 500 to 1000 angstroms.

After sputtering on the indium tin oxide, the 2 mil carrier film was peeled off. The base film thus coated with the phosphor resin layer, designated "B" film, can now be marketed or distributed as a web or in roll form for use in making lamps, display panels, backlighting for various devices, or cut into panels or pieces of desired configuration and dimension.

For the test runs hereinafter described, the B-film thus produced was cut into 3×3 inch square pieces and used in making 2×2 inch lamps. The individual pieces were mounted on a table and bus bars printed on the indium tin oxide face using pure silver ink, followed by drying at 185° F. (85° C.) for ten minutes. A solid back electrode was applied to the reverse side by printing with pure silver ink, followed again by drying at 185° F. for 10 minutes.

Strips of 325 bronze mesh ribbon were attached as leads to the front and back electrodes respectively.

To protect the thus finished lamp elements, these were encapsulated on a nip roll laminator at 270° F. (132° C.) at a pressure of 90 psi (6.3kg/cm$^2$) in a fluorocarbon resin (Aclar TM).

For testing the properties of the lamps the leads were connected to an electric power supply with an oscillator.

A number of runs were made using different light emitting phosphors producing respectively green, yellow and white light.

The general characteristics displayed by the test samples are set out below:

Operating Temperatures

Tested at −10° C. (14° F.) to +80° C. (176° F.) the lamps operated continuously at −10° C. for over 250 hours and at 80° C. for over 400 hours.

Humidity test

95% R.H at 125° F. (49° C.) lamps operated continuously for 300+hours (10+days).

The effects of increases respectively in voltage and frequency of the applied AC current were determined in a large number of runs over the voltage range from 110 to 400 and frequencies (Hz) from 60 to 10,000. In Table 2 below a portion of the obtained data is summarized showing the effects on brightness and power requirements at various voltages and frequencies, using samples having known EL phosphors emitting respectively green, yellow and white light. For the green light the phosphor was copper activated zinc sulfide, for the yellow light zinc sulfide activated with copper and manganese; and for the white light a combination of (a) copper activated zinc sulfide, (b) manganese activated zinc sulfide and (c) zinc sulfide activated with copper and manganese.

TABLE 2

| VOLTS | FREQUENCY (Hz) | CURRENT (MA) | POWER (MW/in$^2$) | BRIGHTNESS (FL) |
|---|---|---|---|---|
| | | WHITE LIGHT | | |
| 220 | 2,000 | 9.43 | 36.31 | 10.80 |
| 220 | 3,000 | 14.24 | 54.82 | 13.50 |
| 250 | 2,000 | 11.38 | 49.79 | 14.40 |
| 250 | 3,000 | 17.62 | 74.46 | 17.90 |
| 300 | 2,000 | 14.52 | 76.23 | 20.50 |
| 300 | 3,000 | 21.65 | 113.66 | 25.70 |
| | | YELLOW LIGHT | | |
| 220 | 2,000 | 9.90 | 38.12 | 10.40 |
| 220 | 3,000 | 14.78 | 56.90 | 12.80 |
| 250 | 2,000 | 11.83 | 51.76 | 13.80 |

TABLE 2-continued

| VOLTS | FREQUENCY (Hz) | CURRENT (MA) | POWER (MW/in$^2$) | BRIGHTNESS (FL) |
|---|---|---|---|---|
| 250 | 3,000 | 17.59 | 76.96 | 17.00 |
| 300 | 1,000 | 6.91 | 36.28 | 11.70 |
| 300 | 2,000 | 15.03 | 78.91 | 19.30 |
| 300 | 3,000 | 22.16 | 116.34 | 23.80 |
| | | GREEN LIGHT | | |
| 120 | 5,000 | 12.8 | 26.88 | 8.02 |
| 500 | 60 | 1.71 | 14.96 | 6.40 |
| 250 | 1,000 | 6.40 | 28.00 | 22.00 |
| 250 | 2,000 | 12.50 | 54.69 | 31.40 |
| 300 | 1,000 | 8.07 | 42.37 | 81.00 |
| 300 | 2,000 | 15.90 | 83.48 | 45.20 |
| 200 | 3,000 | 15.60 | 54.60 | 24.60 |
| 400 | 3,000 | 35.80 | 250.60 | 93.40 |
| 200 | 10,000 | 48.60 | 170.10 | 34.00 |
| 400 | 10,000 | 129.00 | 903.00 | 239.00 |

While the samples of Example 1 were subjected to extensive testing as hereinabove reported, a number of other modifications and variations in the components of the EL lamp structure were tried and found to obtain improved brightness at comparable voltages and frequencies.

Except as otherwise indicated in the specific examples set out below, the general procedure followed in making up the experimental samples was substantially as described in Example 2. These tested samples were not encapsulated in a protective envelope. The resin matrix containing dispersed phosphor was applied directly to the base film by doctor blade or by Mayer rod (#6) at the indicated thickness. The base film, in most instances, was 25 gauge PET or 50 gauge polyvinyl fluoride (PVF); various resin matrices were employed for incorporation of the EL phosphor. Silver was used as the back electrode and as the terminal on the front electrode as in Example 1.

EXAMPLE 2

Commercial copper activated zinc sulfide phosphor of about predominately 6 micron size range was incorporated in a saturated polyester resin matrix in the weight ratio of 73% phosphor and 27% resin.

(a) The polyester resin (formed from polyethylene glycol and maleic acid) was dissolved in organic solvent comprising a mixture of MEK and cyclohexanone and the phosphor dispersed in this solution in a high intensity blender. The phosphor containing resin mixture (73% phosphor by weight) was applied to a 25 gauge preformed PET film to a coating thickness of 1.00 mils and dried at 200° F. Indium tin oxide was sputtered over the resin layer to obtain a coating thickness of 500–600 Å. Over the indium tin oxide surface a bus bar was printed in silver ink and the underside of the PET film was printed with a solid back electrode of silver.

Tested at 200 volts AC and 1,000 Hz (sine) the lamp showed a brightness of 30.0 FL.

(b) The foregoing experiment was modified using more finely divided phosphor (averaging 1 micron particle size) in the weight ratio of 75% phosphor to 22% saturated polyester resin. Tested at 200 volts AC and 1000 Hz, the lamp showed a brightness of 35.0 FL.

(c) The composition of the product in (b) above was further modified by incorporating in the polyester resin matrix a mixture of 1 micron size phosphor and barium titanate composed of (by weight) 60% phosphor and 18% barium titanate in 22% polyester resin.

The thus modified EL lamp displayed good brightness at lower voltages and lower frequency.

Tested at 170 volts AC and 400 Hz, the lamp showed a brightness of 22.0 FL.

EXAMPLE 3

A number of samples were prepared using coated phosphor particles.

(a) Copper activated zinc sulfide particles of 6 micron size were coated with polyvinyl fluoride in amount to furnish 6 monomolecular layers of coating thereon. The coated phosphor was incorporated in a commercial unsaturated polyester resin, employing 73% of coated phosphor and 27% of resin containing 0.5% benzoyl peroxide catalyst. The resin contains two styrene double bonds and is formed from reaction of fumaric acid, maleic anahydride (1:1) with polypropylene glycol and polyethyleneglycol.

The phosphor-containing resin was coated on 25 gauge PET film to obtain a thickness of 1.0 to 1.5 mils.

Tested at 120 volts AC and 400 Hz the lamp showed a brightness of 25.0 FL.

(b) The composition of the sample in Example 3a was modified by substituting for the 73% coated phosphor a mixture comprising 60% of PVF-coated phosphor and 13% barium titanate in 27% resin.

Tested at 120 volts and 400Hz the lamp showed a brightness of 28.0 FL.

EXAMPLE 4

Several samples were prepared using polyvinyl fluoride as the resin matrix for the phosphor.

(a) A mixture of copper-activated zinc sulfide phosphor (63%) and strontium titanate (15%) was incorporated in the PVF resin (22%) and the phosphor-containing resin was applied to 25 gauge PET film at a coating thickness of 1.5 mils.

Tested at 120 volts AC and 400Hz the lamp showed a brightness of 15.0 FL.

(b) A similar sample prepared using barium titanate instead of the strontium titanate had a lower brightness at the same voltage and frequency.

(c) The composition of (a) above was modified by substituting for the 78% mixture of phosphor and strontium titanate, a mixture comprised of 60% phosphor, 13% strontium titanate and 5% indium oxide.

This product displayed good brightness at low voltage. Tested at 80 volts AC and 400Hz, the brightness was 18.0 FL.

(d) The composition of the sample described in (b) and (c) above was modified by incorporating in the polyvinyl fluoride resin matrix (22%) a mixture comprised of 68% copper-activated zinc sulfide and 10% indium oxide.

Tested at 80 volts AC and 400Hz the lamp showed a brightness of 25.0 FL. Apparently the incorporation of indium oxide with the phosphor dispersed in the resin matrix enables the production of products having improved brightness at lower voltage and/or low frequencies. The amount of indium oxide having a beneficial effect reaches a maximum at about 10% by weight of the total phosphor-containing resin layer.

A series of samples were prepared using as the base film 50 gauge polyvinyl fluoride. The thicker film can be employed without an accompanying high loss in brightness of the emitted light, because of the very high dielectric constant of the polyvinyl fluoride and is generally true of other useful plastic films of high dielectric constant (above about 8). At a film thickness of above about 10 microns the use of a support or carrier film is not necessarily needed for the initial handling of the web, since, in most instances, films of such thickness are not too fragile.

EXAMPLE 5

(a) A 50 gauge (12 micron) polyvinyl fluoride film was coated at a coating thickness of 1.5 mils with an unsaturated polyester resin mixture (22%) incorporating therein a mixture of ZnS:Cu phosphor (63%) and strontium titanate (15%). The polyester resin was the same as that used in Example 3a and contained therein 2% dioctyl phthalate and 0.5% benzoyl peroxide. Tested at 120 volts AC and 400 Hz the lamp showed a brightness of 18.0 FL.

(b) The composition in (a) above was modified by substituting for the 78% phosphor plus strontium titanate mixture a mixture composed of 73% copper-activated zinc sulfide plus 5% indium oxide. Tested at 80 volts and 400 Hz, the lamp showed a brightness of 28.0 FL.

A number of different low temperature curable resins were tried for use as matrix for the phosphor.

EXAMPLE 6

(a) Into 27.5% of a resin composed of ethoxy-ethoxy ethyl acrylate (dielectric constant about 5) there was incorporated 72.0% ZnS:Cu phosphor and 0.5% of benzophenone as a U.V. sensitizer. The resin-phosphor mixture was applied to a preformed polyvinylidene chloride base film (PVDC) at a coating thickness of 1.5 mils and the coating was cured at room temperature under moderate pressure using a mercury vapor lamp at 3,650 Å.

The obtained lamp sample tested at 120 volts AC and 400 Hz showed a brightness of 15.0 FL.

(b) Another sample containing a U.V. curable coating was prepared comprising:

| | PBW |
|---|---|
| 2-phenoxyethyl acrylate | 25.0 |
| dioctyl phthalate | 2.0 |
| ZnS:Cu phosphor | 63.0 |
| Indium oxide | 5.0 |
| Benzothiozale (U.V. sensitizer) | 0.5 |

The coating was applied to a polyvinylidene chloride base film at a thickness of 1.5 mils and cured at room temperature by a mercury vapor lamp at 3,650 Å. Tested at 80 volts AC and 400 Hz the sample showed a brightness of 15.0 FL.

(c) The matrix employed was a mixed resin composed of 70 parts hexanediol diacrylate and 30 parts tripropylene diacrylate.

The coating was composed of:

| | PBW |
|---|---|
| Mixed acrylate resin | 22.0 |
| ZnS:Cu phosphor | 73.0 |
| Indium oxide | 5.0 |
| Benzophenone/benzotriazole (1:1) | 0.5 |

The phosphor-containing resin was applied to a base film of PVDC at a coating thickness of 1.5 mils, and cured by exposure at room temperature to a mercury vapor lamp at 3,650 Å. Tested at 80 volts AC and 400 Hz the sample showed a brightness of 22.0 FL.

EXAMPLE 7

Migration of copper ions in the activated phosphor can be prevented by coating the phosphor particles with phosphoric acid. In this way the useful life of the phosphor can be extended.

A phosphor of copper activated zinc sulfide (6 micron size) was dispersed in an unsaturated polyester resin (27%) and the mixture applied as a coating of 1.5 mils to polyvinylidene chloride film. Tested at 170 volts AC and 400 Hz the sample showed a brightness of 20.0 FL.

EXAMPLE 8

Coating of the phosphor particles with quatermary ammonium compounds improves the binding of the phosphor particles.

A sample prepared by coating the copper-activated zinc sulfide phosphor with quatermary ammonium chloride incorporated (73%) in polyester resin (27%) and applied to a polyvinylidene chloride film at a thickness of 1.5 mils. Tested at 170 volts AC and 400 Hz the sample showed a brightness of 25.0 FL.

EXAMPLE 9

(a) Use as matrix for the phosphor a resin blend comprised of cyanoethyl cellulose (7 parts) and an acrylate resin (3 parts) was tried. The coating applied as a layer of 1.5 mils to a base film of polyvinylidene chloride comprised:

| | PBW |
|---|---|
| Mixed resin | 27.0 |
| Strontium titanate | 8.0 |
| Phosphor ZnS:Cu | 65.0 |

The sample tested at 170 volts and 400 Hz showed a brightness of 28.0 FL.

(b) Another sample was prepared using a resin blend of cyanoethyl cellulose and methylmethacrylate (1:1). The coating applied to polyvinyl fluoride film at a thickness of 1.5 mils comprised:

| | PBW |
|---|---|
| Resin blend | 27.0 |
| Strontium titanate | 8.0 |
| ZnS:Cu phosphor | 60.0 |
| Indium oxide | 5.0 |

Tested at 80 volts and 400 Hz the sample showed a brightness of 18.0 FL.

(c) The matrix employed was a polyurethane prepared from butanediol/PEG and TDI.

The coating applied to a polyvinyl fluoride film at a thickness of 1.5 mils comprised:

| | PBW |
|---|---|
| PU resin | 27.0 |
| ZnS:Cu (6 micron) | 68.0 |
| Strontium tantalate | 5.0 |

Tested at 170 volts AC and 400 Hz the sample showed a brightness of 18.0 FL.

A number of samples were prepared to test the effect of applying hydrophobic coating on the phosphor.

EXAMPLE 10

(a) The copper-activated zinc sulfide phosphor (6 micron size) was coated with gamma aminopropyl triethoxy silane at a coating thickness to correspond to 6 monomolecular layers. The coated phosphor (73%) was incorporated in a matrix of unsaturated polyester resin (27%) and applied to a polyvinyl fluoride base film at a thickness of 1.5 mils. Tested at 170 volts AC and 400 Hz the sample showed a brightness of 18.0 FL.

(b) Substituting for the silane coating described in (a) above a mixture of gamma methacryloxy propyl trimethoxy silane and gamma glycidoxy propyl trimethoxy silane, resulted in a product have a brightness of 21.0 FL, tested at 170 volts AC and 400 Hz.

Several samples were prepared which were effectively energized by application of DC current. This was generally accomplished by coating the phosphor with certain electrically conductive materials.

EXAMPLE 11

ZnS:Cu phosphor was coated with an aqueous solution of cupric sulfate and heated at 150° C. for two hours. The coated phosphor (73%) was dispersed in a matrix of unsaturated polyester resin (27%) and the dispersion applied as a coating of 1.5 mils on a film of polyvinyl fluoride. Tested at 28 volts DC the sample had a brightness of 12.0 FL.

A number of samples were prepared in which certain other inorganic compounds were dispersed in the resin matrix in addition to the active phosphor. Most of these proved of little or no recognized advantage from the standpoint of enhancing brightness, although certain differences in the color of the emitted light were detected. Among the inorganic compounds tried were zinc oxide, zinc selenide, cadmium sulfide. Illustrative of these is a sample in which a mixture of 60% copper-activated zinc sulfide and 13% cadmium sulfide was incorporated in a polyester resin matrix and applied to a polyvinyl fluoride film at a thickness of 1.5 mils. Tested at 170 volts and 400 Hz, the samples had a brightness of 18.0 FL.

Products having exceptionally high brightness at low voltages and low frequencies were prepared as described in the following examples 12 to 15.

EXAMPLE 12

To the surface of a 25 gauge PET film there was applied a layer of strontium titanate at a thickness of about 1000 Å. Over the strontium there was applied at a coating thickness of 1.5 mils a layer of polyester resin (27%) incorporating copper-activated zinc sulfide phosphor (27%). Over the phosphor-containing resin layer there was next applied a second coating of strontium titanate, followed by sputtering on the surface thereof a transparent coat of indium tin oxide to serve as the front electrode. A coating of flake silver was applied to the under face of the PET film to serve as the back electrode. The sample tested at 80 volts AC and 400 Hz showed a brightness of 80 FL.

EXAMPLE 13

To the surface of a 25 gauge PET film there was applied a thin layer of strontium titanate (as in Example 11) and over the titanate surface the phosphor-containing resin layer coating was applied at a thickness of 1.5 mils. The resin layer contained in addition to the ZnS:Cu phosphor 10% barium titanate, so that the resin layer composition was 68% phosphor, 10% titanate and 22% polyester resin. Over the surface of the resin matrix there was next deposited by sputtering a layer of yttrium oxide and overlaid by sputtering on a layer of indium tin oxide as the transparent front electrode. The underface of the PET film was coated with silver as the back electrode. Tested at 80 volts AC and 400 Hz the sample displayed a brightness of 100 FL.

EXAMPLE 14

Over the surface of 25 gauge PET film there was applied a thin coat of strontium titanate (as in Example 12) and over the titanate surface the phosphor-containing resin matrix was applied at a coating thickness of 1.5 mils. The resin layer comprised: 63% ZnS:Cu phosphor of 6 micron size, 10% indium oxide of 1 micron particle size in 27% polyester resin. A second coating of strontium titanate was applied over the surface of the phosphor-containing resin matrix and surface coat of indium tin oxide sputtered over the strontium titanate surface. Tested at 80 volts AC and 400 Hz the sample showed a brightness of 120 FL.

EXAMPLE 15

A layer of strontium titanate was applied to the surface of 25 gauge PET film as in the previous Example 14 and over coated with a resin mixture composed of: 60% ZnS:Cu, 8% indium oxide and 5% barium titanate in 27% of polyester resin. The resin layer was covered with strontium titanate and overlaid with indium tin oxide as in the previous example. To serve as a protective layer, instead of encapsulating the laminate, the indium tin oxide surface was covered with a layer of silicon oxide. Tested at 80 volts AC and 400 Hz the sample had a brightness of 120 FL.

While in the specific examples set out above silver was employed as the back electrode and as the bus bar terminal printed on the transparent front electrode, other metals having high electrical conductivity may be substituted such as nickel powder.

The preferred resin for use as matrix for incorporation of the phosphor is UV curable polyester resin. In the runs made, no particular advantage was observed with respect to using saturated versus unsaturated polyester resins.

Based on extensive testing of a large number of EL devices constructed in accordance with the present invention it can be generally summarized:

A. Increasing amounts of EL Phosphor in the resin matrix effects increased brightness within the range of up to about 73% phosphor by weight of resin matrix layer. The brightness increase is due to the packing of the particles of narrow particle size distribution.

B. Use of phosphor having a predominant particle size in the range $1\mu$ to $6\mu$ obtains an optimum resonance.

C. Inclusion of up to 20% of alkaline earth metal titanate in the resin matrix in addition of phosphor results in a synergistic effect in stabilizing the migration of the electrons.

D. Inclusion of an electrically conductive additive, such as titanium dioxide with the phosphor dispersed in the resin matrix, up to a possible maximum of 10% $TiO_2$, results in better charge transfer yielding higher brightness.

E. The use of a resin matrix having a sufficiently high dielectric constant at or above about 8 results in better media for charge transfer resulting in higher brightness.

F. By limiting the thickness of the "B" film (25 gauge) good electrical properties viz. good dielectric constant, capacitance and dielectric strength are obtained.

G. The use of a particulate insulator sputtered on the base film between that film and the phosphor-containing resin matrix as well as on the surface of the matrix (i.e. between the matrix and the transparent front electrode) yielded a high brightness and prevented the migration of the dopant that would result in rapid decay.

H. Coating of the phosphor particles with polyvinyl fluorides or with phosphoric acid or silanes or with quartermany ammonium compound resulted in good adhesion of the phosphor particles to the resin matrix, (b) high resistance to moisture vapor transmission and migration of other chemical impurities that act as poisons (c) good bonding (d) good dielectric media.

What is claimed:

1. The method of producing a thin flexible electroluminescent element which comprises the steps of:

releaseably mounting on a carrier web comprised of a relatively thick flexible plastic film a preformed thin plastic base film, thoroughly and uniformly dispersing in a thermoplastic resin matrix particles of an electroluminescent phosphor, depositing the obtained dispersion as a coating layer on the exposed upper surface of the mounted base film, bonding the phosphor-containing resin coating to the mounted base film by passing the thus coated film and carrier web through calendering rollers under pressure and at elevated temperature;

with or without first stripping the carrier web from the coated base film, directly sputtering on the exposed surface of the phosphor-containing resin matrix a thin transparent layer of electrical conducting material to serve as a front electrode;

applying to a selected portion of the transparent front electrode an electrical connection terminal formed of a metal having high electrical conductivity;

and, after stripping the carrier web from the base film, applying to one or more discrete areas of the exposed underside the base film, a metal facing of high electrical conductivity to serve as one or more back electrodes.

2. The method as defined in claim 1 wherein said base film is selected from the group consisting of polyester resins and polyvinyl fluoride resins.

3. The method as defined in claim 2 wherein said base film has a thickness of no more than about 10 microns.

4. The method as defined in claim 2 wherein said base film has a thickness in the range of about 5 to 8 microns.

5. The method as defined in claim 4 wherein said base film is polyethylene terephalate.

6. The method as defined in claim 5 wherein said transparent front electrode comprises indium tin oxide.

7. The method as defined in claim 5 wherein said resin matrix comprises a resin selected from the group consisting of saturated and unsaturated polyester resins, polyvinyl fluoride, acrylates, methacrylates, cyanoethyl starch, cyanoethyl cellulose and polyurethanes.

8. The method as defined in claim 5 wherein said resin matrix is a polyester resin.

9. The method as defined in claim 8 wherein said resin matrix has dispersed therein an alkaline earth metal titanate.

10. The method as defined in claim 8 wherein said resin matrix has dispersed therein indium oxide in an amount not exceeding 10% by total weight of said deposited resin coating layer.

11. The method as defined in claim 8 wherein said phosphor is activated zinc sulfide coated with polyvinylidene fluoride.

12. The method as defined in claim 8 wherein said phosphor is activated zinc sulfide coated with phsohporic acid.

13. The method as defined in claim 8 wherein said phosphor is activated zinc sulfide coated with a quatermary ammonium compound.

14. The method as defined in claim 8 wherein said phosphor is activated zinc sulfide coated with one or more organic silane compounds.

15. The method as defined in claim 8 wherein said phosphor is activated zinc sulfide coated with copper sulfate.

16. The method as defined in claim 5 wherein said phosphor-containing resin matrix is an unsaturated polyester resin.

* * * * *